US006255267B1

(12) United States Patent
Nayar et al.

(10) Patent No.: US 6,255,267 B1
(45) Date of Patent: Jul. 3, 2001

(54) MANUAL TOILET BOWL CLEANER

(75) Inventors: Bala C. Nayar, Dayton; Ronnie A. Carroll, Fair Lawn; Kenneth J. Ward, Basking Ridge, all of NJ (US)

(73) Assignee: HPD Laboratories, Inc., Edison, NJ (US)

( * ) Notice: Subject to any disclaimer, the term of this patent is extended or adjusted under 35 U.S.C. 154(b) by 0 days.

(21) Appl. No.: 08/610,454

(22) Filed: Mar. 4, 1996

(51) Int. Cl.[7] ..... C11D 3/395

(52) U.S. Cl. ..... 510/191; 510/192; 510/193; 510/389; 510/535; 510/536; 510/537

(58) Field of Search ..... 510/191, 192, 510/193, 389, 535, 536, 537

(56) References Cited

U.S. PATENT DOCUMENTS

| | | | | |
|---|---|---|---|---|
| 3,754,941 | | 8/1973 | Burke | 106/3 |
| 4,090,967 | | 5/1978 | Falk | 252/3 |
| 4,145,303 | | 3/1979 | Loudas | 252/156 |
| 4,213,870 | | 7/1980 | Loran | 252/51.5 R |
| 4,287,080 | | 9/1981 | Siklosi | 252/104 |
| 4,353,892 | | 10/1982 | Caslavsky | 424/52 |
| 4,606,842 | * | 8/1986 | Keyes et al. | 520/243 X |
| 4,963,287 | | 10/1990 | Hutchings et al. | 252/187.23 |
| 5,049,299 | * | 9/1991 | Banczk et al. | 510/193 X |
| 5,110,868 | | 5/1992 | Bellis et al. | 252/174.23 |
| 5,256,328 | * | 10/1993 | Cavanagh et al. | 510/191 |
| 5,639,722 | * | 6/1997 | Kong et al. | 510/191 |

* cited by examiner

*Primary Examiner*—Michael Lusignan
(74) *Attorney, Agent, or Firm*—Bazerman & Drangel, P.C.

(57) ABSTRACT

The present invention is an improved liquid toilet bowl cleanser comprising a fluorosurfactant coating agent, an anionic or non-ionic cleaner and a rheology control agent together with other minor excipients. The flurosurfactant continually adheres to and coats the porcelain surface of the toilet bowl during the active life of the cleanser composition preventing the formation of toilet bowl stains and mineral deposits for a substantial period of time after manual cleaning.

22 Claims, No Drawings

MANUAL TOILET BOWL CLEANER

FIELD OF THE INVENTION

The present invention relates generally to cleansers and disinfectants for toilets and urinals. More specifically, the present invention relates to an improved liquid toilet bowl cleaning composition that provides continual and long lasting cleanser action and protection through the deposition of a coating agent about the exposed bowl surface.

BACKGROUND OF THE INVENTION

Many efforts have been made over the years to make the drudgery of cleaning bathrooms, and toilets in particular, less of an unpleasant chore. Whereas toilet cleaning generally required the rigorous scrubbing of the bowl with a brush and an abrasive powdered bleach or detergent, automatic toilet bowl cleaners have been around now for a number of years and require little more effort than the customary flush that one conducts after each use. These cleaners generally consist of a liquid, a solid tablet or a granular material that is dropped in the cistern or tank which sits atop the bowl. Liquid and granular formulations are generally provided in plastic dispensing containers or bottles whereas the solid formulations may just consist of the solid tablet itself. The cleanser/sanitizer slowly dissolves in the water of the tank and with each flush is released to the bowl where it swirls about, cleansing and disinfecting the anionic porcelain surface.

Solid lavatory or urinal cleansing compositions are commonly utilized today to clean, deodorize and disinfect toilet water and toilet fixtures. These compositions are typically shaped in the form of "blocks" or "cakes" and are placed by the user in the toilet tank or bowl, or in urinals. The blocks are then designed to slowly dissolve and thereby release part of their active composition over time. It is this time-released attribute which many have found to be invaluable in dispensing functional agents to the water. In many instances, the action of flushing also serves to further dispense the active ingredients.

Liquid toilet bowl cleaners on the other hand must be applied manually and are generally comprised of gel or viscous liquid that is squirted from a squeezable container or bottle about the upper rim of the toilet bowl. Some formulations are left to slowly coat the bowl surface through gravitational pull and clean over several hours or, in most cases, a brush is used to manually scrub the surface and the dirt, grime and soap scum is then flushed away.

There are many different formulations known in the art with respect to both types but all generally comprise a water soluble surfactant, a halogen releasing agent, binders, dyes, fillers and perfumes.

Surfactants, more generically known as soaps or detergents, are surface active agents that clean soiled or stained surfaces by lowering the surface tension or surface energy that binds two materials, in this case two solids, together. Surfactants concentrate at the solid-solid or solid-liquid interface between two materials and reduce the surface tension at this point thereby separating the two which cleans the surface.

Many toilet bowl cleansers employ a variety of halogen-containing materials that are known to serve as disinfecting and/or sanitizing agents. These materials are believed to function as disinfecting agents by virtue of the formation of a hypohalite ion, e.g., hypochlorite ion, or hypohalous acid, e.g., hypochlorous acid, when the material is dissolved in a aqueous medium. Typically, the halogen-containing material is a chlorine, bromine, iodine or chlorine and bromine-containing material. Representative examples of such halogen-containing materials include: the hypochlorites, such as lithium hypochlorite and calcium hypochlorite, chlorinated isocyanuric acids, such as dichloroisocyanuric acid and its sodium and potassium salts, trichloroisocyanuric acid, the chlorinated and brominated hydantoins, such as 1,3-dibromo-5,5-dimethylhydantoin, the N-halo-2-oxazolidinones, such as 3-chloro-4,4-dimethyl-2-oxazolidinone, and N,N-dihalo-2-imidazolidinones, such as 1,3-dichloro-4,4,5,5-tetramethyl-2 imidazolidinone.

The dye or coloring agent imparts a colored hue to the otherwise clear toilet bowl water and this serves two purposes. On the one hand, the dye adds a certain aesthetic value in that the blues and greens of the dyes known in the art are pleasing to the eye. More importantly, the dye serves as an indicator function in that it's absence, when depleted, also indicates the depletion of the cleanser/disinfectant and serves notice that the depleted cleanser/disinfectant is no longer present or active.

A problem inherent with many of the halogen disinfectants, surfactants and dyes is their relatively caustic nature which is a necessary attribute for the cleaning of these plumbing fixtures. The surfaces of most toilet bowls on the other hand, is generally comprised of porcelain which is susceptible to attack by the ions formed by these compounds when dissolved in water. The toilet bowl surfaces are generally anionic by nature while many of the halogens, surfactants and dyes form cations when released in solution. These cations, as well as naturally occurring minerals found in the systems water will often bond to and stain the anionic porcelain surface. Orange iron spots are commonly seen as a result of high iron levels in the water supply. If left untreated, these can become quite unseemly and are difficult to remove at best.

One solution to removing and preventing the appearance of these stains would be to incorporate a water insoluble component in the cleanser/disinfectant composition that would somehow be attracted to or adhere to the anionic surface of the toilet bowl so as to form a protective coating. U.S. Pat. No. 4,145,303 to Loudas for example, discloses a fluorochemical detergent composition for the cleaning of carpets, upholstery, leather and the like which also imparts a water, oil and stain repellant thereto. A composition that could provide the same functions in a toilet bowl cleanser would likewise have substantial utility.

U.S. Pat. No. 3,754,941 to Burke discloses compositions useful in the cleaning and removal of metallic stains from a porcelain toilet bowl. The compositions are comprised of a metallic salt oxidant such as mercuric chloride coupled with a fluoride solubilizer and a halide activator. The fluoride solubilizer is a surfactant which assists the metallic oxidant with the removal of stains from the porcelain surface by altering the adherence force of the stain to the surface. The halide promoter is selected from the group comprising chloride, bromide and iodide and these activate the metallic salt oxidant whereby stain removal is increased.

It is an object of the present invention to provide a sustained release, continual dispersion of a toilet bowl cleanser which not only cleans but protects toilet bowl surfaces as well. The present invention achieves this goal through the use of a fluorosurfactant coating agent, an anionic or nonionic cleaner, a rheology control agent and aesthetically enhancing excipients. As the cleaning agents remove mineral deposits, surface stains, dirt, grime and the like from the porcelain surface, the fluoro-surfactant adheres to and coats the surface continually preventing or inhibiting further stain and deposit formation.

SUMMARY OF THE INVENTION

The present invention is an improved liquid toilet bowl cleanser comprising a fluorosurfactant coating agent, a sulfonic cleaner and a rheology control agent together with other minor excipients. Upon application, the fluorosurfactant continually adheres to and coats the porcelain surface of the toilet bowl during the active life of the cleanser composition preventing the formation of toilet bowl stains and mineral deposits.

DETAILED DESCRIPTION OF THE INVENTION

Fluorocarbon surfactants are analogs of conventional hydrocarbon surfactants wherein a part or even all of the hydrogen atoms along the carbon molecular backbone have been replaced with fluorine atoms. They are characterized as being both anionic and nonionic surfactants, a well known example of which is perfluorooctanoic acid. Fluorosurfactants often outperform other hydrocarbon surfactants in cleaning efficacy as they lower the interfacial surface tensions between two states of matter to a greater degree. Fluorosurfactants also exhibit synergistic effect when used in combination with other types of surfactants.

The fluorosurfactants that are useful as coating agents in the practice of the present invention have the following general chemical structure:

$$CF_2(CF_2)n\ CH_2CH_2—X$$

where n is a number from 3 to 17 and X is a hydrophilic moiety selected from the group comprising ethoxylate, phosphate, sulfonate, quaternary amine and mixtures thereof.

These fluorosurfactants are available commercially under the trade name Zonyl® from the DuPont Co., Wilmington, Del. These include Zonyl FSA, FSP, FSE, UR, FSJ, FSO, FSO-100, FS-300, FSN, FSN-100 and TBS. More specifically, the coating agent is selected from the group of fluorosurfactants having the following chemical structures:

a) $R_fCH_2CH_2SCH_2CH_2CO_2Li$
b) $(R_fCH_2CH_2O)P(O)(ONH_4)_2(R_fCH_2CH_2O)_2P(O)(ONH_4)$
c) $(R_fCH_2CH_2O)P(O)(OH)_2(R_fCH_2CH_2O)_2P(P)(OH)$
d) $R_fCH_2CH_2O(CH_2CH_2O)_xH$
e) $R_fCH_2CH_2O(CH_2CH_2O)_yH$
f) $R_fCH_2CH_2SO_3H$ where $R_f$=$F(CF_2CF_2)_{3\text{-}8}$ and x, y are numbers from 1 to 50 Use of these surfactants in combination as mixtures is also contemplated herein. These are employed in the toilet bowl cleaner composition in very small amounts of from about 0.15% to about 0.40% and preferably from about 0.20% to about 0.30% and most preferably in an amount of about 0.25% based on the total weight of the composition.

The cleaning surfactant that is employed as a cleaning agent in the formulation is anyone of a number of nonionic or anionic surfactants, in particular, an amido sulfonate complex such as dodecyl benzene sulfonic acid that has been neutralized with cocomide diethanolamine. This surfactant is commercially available as Monaterge ALX-100S (Mona Industries, Paterson N.J.). Other suitable cleaning agents include the alkali metal salts of alkyl substituted benzene sulfonic acids, alkali metal salts of long chain fatty sulfates, alkali metal ether sulfates derived from alcohols and alkyl phenols, alkali metal sulphosuccinates, alkali metal sarcosinates, alkali metal taurides and mixtures thereof. The cleaning agent is incorporated into the toilet bowl cleaner in amounts of from about 1.5% to about 5.0% based on the total weight of the toilet bowl cleaner composition. Preferably, the cleaner comprises from about 2.0% to about 3.0% of the composition and most preferably it is incorporated in an amount of about 2.5%.

A rheology control agent is added to thicken the system and give it more consistency and body for ease of use and application. Preferably these are selected from the group consisting of cross-linked polyacrylic acid homopolymers commercially available as Carbopol® (BF Goodrich Specialty Chemicals, Cleveland, Ohio). Other known thickeners that may be used include hydrocolloids such as xanthan gum, guar gum, hydroxy-propyl ethyl cellulose, hydroxy propyl methyl cellulose and mixtures thereof. The rheology control agent is incorporated into the toilet bowl cleaner composition in amounts of from about 0.2% to about 0.35% and preferably in an amount of about 0.225% based on the total weight of the composition.

Excipients that improve the aesthetic value of the cleaner such as perfumes, dyes, sanitizes, etc. may also be incorporated into the toilet bowl cleanser of the present invention. Suitable perfumes and dyes are well known to those skilled in the art and can be selected accordingly.

The liquid toilet bowl cleanser of the present invention may be formulated as a clear liquid or as a colored, opaque viscous solution that is squirted completely around the upper rim of the toilet bowl. As the liquid seeps down the sides of the bowl it is then scrubbed with a brush about the porcelain surface. Once thoroughly scrubbed, the toilet is flushed and the stains or dirt previously attached thereto are washed away. The fluorosurfactant however, remains attached to the porcelain wall as a thin, protective coating.

The following examples are provided to more specifically disclose the formulations that comprise various embodiments of the claimed invention. They are for illustrative purposes only however, and it is recognized that minor changes and variations may be made to the components or their amounts that are not contemplated herein. It is to be understood that any such changes that do not materially affect the final product and its functionality are considered to fall within the spirit and scope of the invention as recited by the claims that follow.

EXAMPLE 1

The following ingredients were mixed to prepare the toilet bowl cleanser of the present invention. Percents given are based upon the total weight of the composition.

| | Weight Percent |
|---|---|
| 1) Fluoro alkyl alcohol substituted monoether with polyethylene glycol (Zonyl FS-300) | 0.25% |
| 2) Dodecyl benzyl sulfonic acid and cocomide DEA (Monaterge AXL-100S) | 2.5% |
| 3) Carbopol 675 | 0.225% |
| 4) Perfume | 0.375% |
| 5) Acid Blue #9 | 0.002% |
| 6) Preservative | 0.1% |
| 7) Deionized Water | 96.55% |
| | 100% |

The mixture had a final viscosity of 700 cps as measured by a Brookfield viscometer, Model RVT using a #1 spindle at 10 r.p.m.

Two American Standard toilets were thoroughly cleaned and flushed several times with water. One toilet was then cleaned with the above referenced formulation (the product was dispensed through an angle-neck bottle under the rim and allowed to sit on the surface for 10 minutes, and then brushed and flushed). The other toilet received no treatment. An equal amount of a fish oil stain, colored brown and thickened, was uniformly applied all around the inner surface of the bowls of both toilets. After waiting 5 minutes, both toilets were flushed five times. The experiment showed that the toilet treated with the formulation of the present invention had significantly less stain on the porcelain surface than the untreated toilet.

EXAMPLE 2

The efficacy of the toilet bowl cleaner of the formulation set forth in Example 1 was demonstrated as follows. The toilet bowl was cleaned thoroughly and dried above the water line. The left side was treated with the formulation from example 1 using a sponge (approx. few grams of the product were applied). The right side was not treated. The toilet was allowed to air dry for a few minutes. A cod liver oil stain, colored and thickened, was applied to both left and right sides of the toilet uniformly. After one flush, a significant amount of stain remained on the untreated side while there was virtually no stain on the treated side. This conclusively shows that the fluorosurfactant active is effective at low levels and in the presence of cleaning surfactants to repel stains by providing an invisible coating on the bowl surface.

EXAMPLE 3

The fluorosurfactant cleaning composition of the present invention was tested as to its ability to clean and eliminate heavy stains from the surface of toilet bowls. The composition was compared to two commercially available products. The following ingredients were combined in formulation to prepare the cleaner of the present invention. Percents given are based on total weight of the composition.

| | Weight Percent |
|---|---|
| 1) Fluoroalkyl alcohol substituted monoether with PEG (Zonyl FS-300) | 0.50% |
| 2) Dodecyl benzyl sulfonic acid and cocomide DEA (Monaterge AXL-100S) | 5.0% |
| 3) Natrasol 250 HHR | 0.5% |
| 4) Perfume | 0.5% |
| 5) Acid Blue #9 | 0.002% |
| 6) Preservative | 0.10% |
| 7) Deionized Water | 93.40% |
| | 100% |

Fish oil emulsion was stained on three (3) sets of unglazed porcelain tiles. The cleaner of the present invention was applied to one set and two commercially available brands, Ty-D-Bol® and Toilet Duck® were applied to the other two. Each was scrubbed using a Gardner Abrasion Tester. Visual and instrumental inspection showed that the present formulation removed substantially all of the stain while some fish oil residue remained on the other stained porcelain tile sets.

EXAMPLE 4

The toilet bowl cleaner formulation of example 1 was compared with a well known commercially available brand for its ability to minimize toilet bowl staining through use. A standard toilet bowl was first thoroughly cleaned with Vanish® toilet bowl cleaner. The bowl was then stained with fish oil emulsion. After an adequate time to set the stain, the toilet was flushed and cleaned with Vanish® again to remove the stains. A second toilet was treated with the toilet bowl cleaner of the present invention. Both comparative cleanings were performed several times. In each instance, whereas the Vanish-cleaned toilet exhibited a filmy residue about the rim and body of the bowl, no such residue was formed in the toilets cleaned by the formulation of example 1, all of which were substantially cleaner.

EXAMPLE 5

The liquid toilet bowl cleanser of the present invention was used to clean a toilet bowl that had been heavily stained. The formulation of ingredients was mixed as follows:

| | Weight Percent |
|---|---|
| 1) Fluoroalkyl thiopropionate lithium salt (Zonyl FSA) | 0.50% |
| 2) Dodecyl benzyl sulfonic acid and cocomide DEA (Monaterge AXL-100S) | 5.0% |
| 3) Natrasol 250 HHR | 0.5% |
| 4) Perfume | 0.5% |
| 5) Acid Blue #9 Dye | 0.002% |
| 6) Preservative | 0.10% |
| 7) Deionized Water | 93.40% |
| | 100% |

The toilet bowl was heavily stained by applying a thick fish oil emulsion about its perimeter which was allowed to set for several days. The liquid cleanser was applied, scrubbed and rinsed. Not only was the bowl immediately cleaned, subsequent applications of the oil did not readily adhere to the sides of the bowl.

What we claim is:

1. An improved liquid toilet cleanser composition useful in the reduction and prevention of toilet bowl stains comprising:

a) a fluorosurfactant coating agent b) an anionic or nonionic cleaner c) a rheology control agent, and d) aesthetically enhancing excipients.

2. The improved liquid cleanser composition of claim 1 wherein said coating agent is selected from the group having the general chemical structure $CF_2(CF_2)n\ CH_2CH_2—X$ where n is a number from 3 to 17 and X is a hydrophilic moiety selected from the group comprising ethoxylate, phosphate, sulphonate, quaternary amines and mixtures thereof.

3. The improved liquid cleanser composition of claim 2, wherein said coating agent is selected from the group of fluorosurfactants having the following chemical structures, or mixtures thereof:

a) $R_fCH_2CH_2SCH_2CH_2CO_2Li$ b) $(R_fCH_2CH_2O)P(O)(ONH_4)_2(R_fCH_2CH_2O)_2P(O)(ONH_4)$ c) $(R_fCH_2CH_2O)P(O)(OH)_2(R_fCH_2CH_2O)_2P(P)(OH)$ d) $R_fCH_2CH_2O(CH_2CH_2O)_xH$ e) $R_fCH_2CH_2O(CH_2CH_2O)_yH$ f) $R_fCH_2CH_2SO_3H$ where $R_f$=$F(CF_2CF_2)_{3-8}$ and x, y are numbers from 1 to 50.

4. The improved liquid cleanser of claim 3 wherein said anionic or nonionic cleaner is selected from the group comprising dodecyl benzene sulfonic acid, dodecyl benzene sulfonic acid neutralized with cocomide diethanolamine, amido sulfonate surfactants, nonionic surfactants, anionic surfactants, and mixtures thereof.

5. The improved liquid cleanser composition of claim 4 wherein said rheology control agent is selected from the group consisting of, xanthan gum, gellan gum, hydroxy propyl cellulose, hydroxy propyl methylcellulose, hydroxyethyl propyl cellulose, guar gum and mixtures thereof.

6. The improved liquid cleanser of claim 5 wherein said aesthetically enhancing excipients are selected from the group comprising perfumes, water coloring dyes, preservatives and mixtures thereof.

7. The improved cleanser of claim 6 wherein said fluorosurfactant coating agent is incorporated in said cleanser in an amount of from about 0.05 wt. % to about 0.5 wt. % of the total weight of the composition.

8. The improved cleanser of claim 7 wherein said coating agent comprises form about 0.15 wt. % to about 0.35 wt. % of the total weight of the composition.

9. The improved cleanser of claim 8 wherein said anionic or nonionic cleaner comprises from about 0.5 wt. % to about 5.0 wt. % of the total weight of the composition.

10. The improved cleanser of claim 9 wherein said anionic or nonionic cleaner comprises from about 1.5 wt. % to about 3.5 wt. %.

11. The improved toilet cleanser of claim 10 wherein said rheological control agent is incorporated in said composition in an amount of from about 0.15 wt. % to about 0.35 wt % of the total weight of the composition.

12. The improved toilet cleanser composition comprising a fluorosurfactant coating agent that reduces and prevents toilet bowl stains through the adherence and coating of the porcelain anionic surface.

13. The improved cleanser of claim 12 further comprising an anionic or nonionic cleaning agent, a Theological control agent, dyes, perfumes and mixtures thereof.

14. The improved cleanser of claim 13 wherein said fluorosurfactant coating agent is selected from the group having the general chemical structure $CF_2(CF_2)n\ CH_2CH_2$—X where n is a number from 3 to 17 and X is a hydrophilic moiety selected from the group comprising ethoxylate, phosphate, sulphonate, quaternary amines and mixtures thereof.

15. The improved liquid cleanser composition of claim 14, wherein said coating agent is selected from the group of fluorosurfactants having the following chemical structures, or mixtures thereof:

a) $R_fCH_2CH_2SCH_2CH_2CO_2Li$ b) $(R_fCH_2CH_2O)P(O)(ONH_4)_2(R_fCH_2CH_2O)_2P(O)(ONH_4)$ c) $(R_fCH_2CH_2O)P(O)(OH)_2(R_fCH_2CH_2O)_2P(P)(OH)$ d) $R_fCH_2CH_2O(CH_2CH_2O)_xH$ e) $R_fCH_2CH_2O(CH_2CH_2O)_yH$, and;

f) $R_fCH_2CH_2SO_3H$ where $R_f$=$F(CF_2CF_2)_{3\text{-}8}$ and x, y are numbers from 1 to 50.

16. The improved cleanser of claim 15 wherein said anionic or non-ionic cleaners is selected from the group comprising dodecyl benzene sulfonic acid, dodecyl benzene sulfonic acid neutralized with cocomide, diethanolamine, amido-sulfonate surfactants, nonionic surfactants, anionic surfactants, and mixtures thereof.

17. The improved cleanser composition of claim 16 wherein said rheology control agent is selected from the group consisting of, xanthan gum, gellan gum, hydroxy propyl cellulose, hydroxy propyl methylcellulose, hydroxyethyl propyl cellulose, guar gum and mixtures thereof.

18. The improved cleanser of claim 17 wherein said fluorosurfactant coating agent is incorporated in said cleanser in an amount of from about 0.05 wt. % about 0.5 wt. % of the total weight of the composition.

19. The improved cleanser of claim 18 wherein said coating agent comprises from about 0.15 wt. % to about 0.35 wt. % of the total weight of the composition.

20. The improved cleanser of claim 19 wherein said anionic or nonionic cleaner comprises from about 0.5 wt. % to about 5.0 wt. %.

21. The improved cleanser of claim 20 wherein said anionic or nonionic cleaner comprises from about 1.5 wt. % to about 3.5 wt. %.

22. The improved toilet cleanser of claim 21 wherein said rheological control agent is incorporated in said composition in an amount of from about 0.15 wt. % to about 0.35 wt %.

* * * * *